US006815598B1

(12) United States Patent
Liao

(10) Patent No.: US 6,815,598 B1
(45) Date of Patent: Nov. 9, 2004

(54) ANCHOR STRUCTURE FOR ACCESSORIES OF A MUSICAL INSTRUMENT STAND

(76) Inventor: Tsun-Chi Liao, 1F, No.7, Lane 545, Sec. 2, Chun-Kung Rd., Taichung City (TW)

( * ) Notice: Subject to any disclaimer, the term of this patent is extended or adjusted under 35 U.S.C. 154(b) by 78 days.

(21) Appl. No.: 10/286,895

(22) Filed: Nov. 4, 2002

(51) Int. Cl.[7] ..... G10D 3/00

(52) U.S. Cl. ..... 84/327; 84/421; 84/329; 84/453

(58) Field of Search ..... 84/327, 421, 329, 84/453

(56) References Cited

U.S. PATENT DOCUMENTS 6,316,706 B1 * 11/2001 Sammons ..... 84/327

6,323,405 B1 * 11/2001 Yu ..... 84/327

* cited by examiner

*Primary Examiner*—Shih-Yung Hsieh
(74) *Attorney, Agent, or Firm*—Birch, Stewart, Kolasch & Birch, LLP

(57) ABSTRACT

An anchor structure for accessories of a musical instrument stand mainly uses the spared space between the foot rack and the post of the instrument stand by coupling the anchor structure with an anchor section of the post to hold a microphone or additional instruments. The anchor structure includes an anchor unit fixedly fastened to the anchor section, a holding unit for holding the microphone and the additional instruments, and an adjusting unit which has two ends coupling respectively with the anchor unit and the holding unit to form connection relationship. The invention thus constructed can support the microphone or additional instruments without requiring extra space.

10 Claims, 6 Drawing Sheets

ANCHOR STRUCTURE FOR ACCESSORIES OF A MUSICAL INSTRUMENT STAND

FIELD OF THE INVENTION

The present invention relates to an anchor structure for accessories of a musical instrument stand and particularly an instrument rack for holding pulsatile or percussion instruments.

BACKGROUND OF THE INVENTION

The commonly used instrument stands for pulsatile or percussion instruments generally have to support drums of various sizes. How to hold other accessories such as microphones, cymbals or bells becomes a big problem. As the percussion instruments usually have large sizes, and they are often arranged in a semicircular fashion in front of the drummer during performance, effective space utilization becomes very important. How to hold and arrange the additional accessories becomes an annoying issue.

In order to resolve the problems mentioned above, and to enable drummers to perform the percussion instruments handily to produce desired audio effect, it is a general practice to add an additional holding platform either integrally to the instrument stand or externally for holding other pulsatile instruments such as cymbals or bells. As the space above the foot rack of the instrument stand is free for use other than the post, no additional space is required. However, such an approach is not totally desirable. This is because every drummer has his/her special habits. Mounting the additional holding platform in a fixed manner may be suitable for a few drummers, but the drums or other accessories may have to be rearranged in many other occasions to achieve the best performance results. Thus the fixed anchoring approach has constraints in practice, and is not cost-effective.

SUMMARY OF THE INVENTION

Therefore the primary object of the invention is to resolve the aforesaid disadvantages. The invention aims at utilization the spared space between the foot rack and the post of the instrument stand to install an anchor structure on an anchor section of the post to hold a microphone or other additional instruments. The anchor structure includes an anchor unit fastening to the anchor section, a holding unit for holding a microphone and additional instruments, and an adjusting unit which has two ends fastening to the anchor unit and the holding unit to form connecting relationship so that no extra space is required to hold the microphone and the additional instruments.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
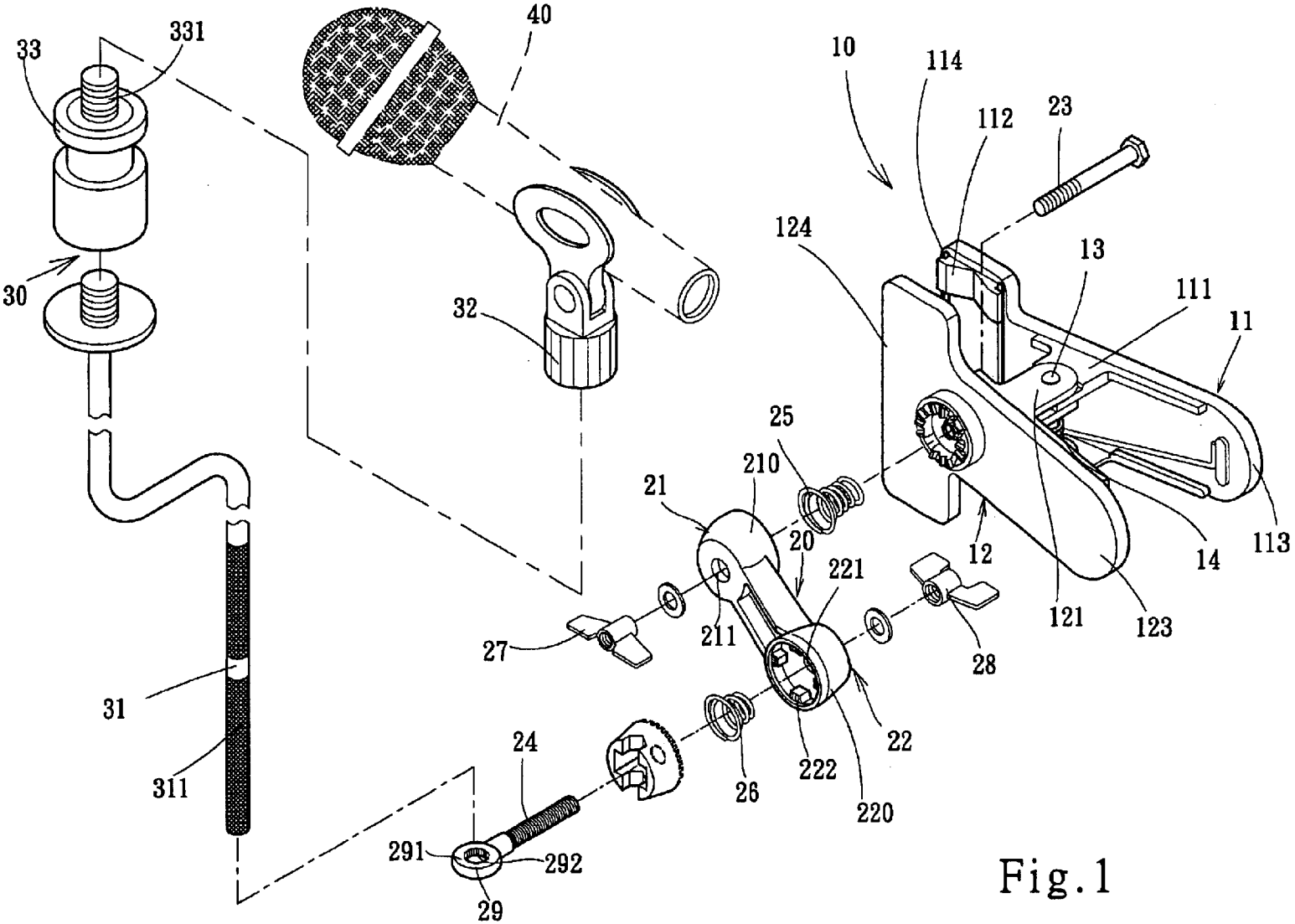
FIG. 1 is an exploded view of an embodiment of the invention.
Figure 2:
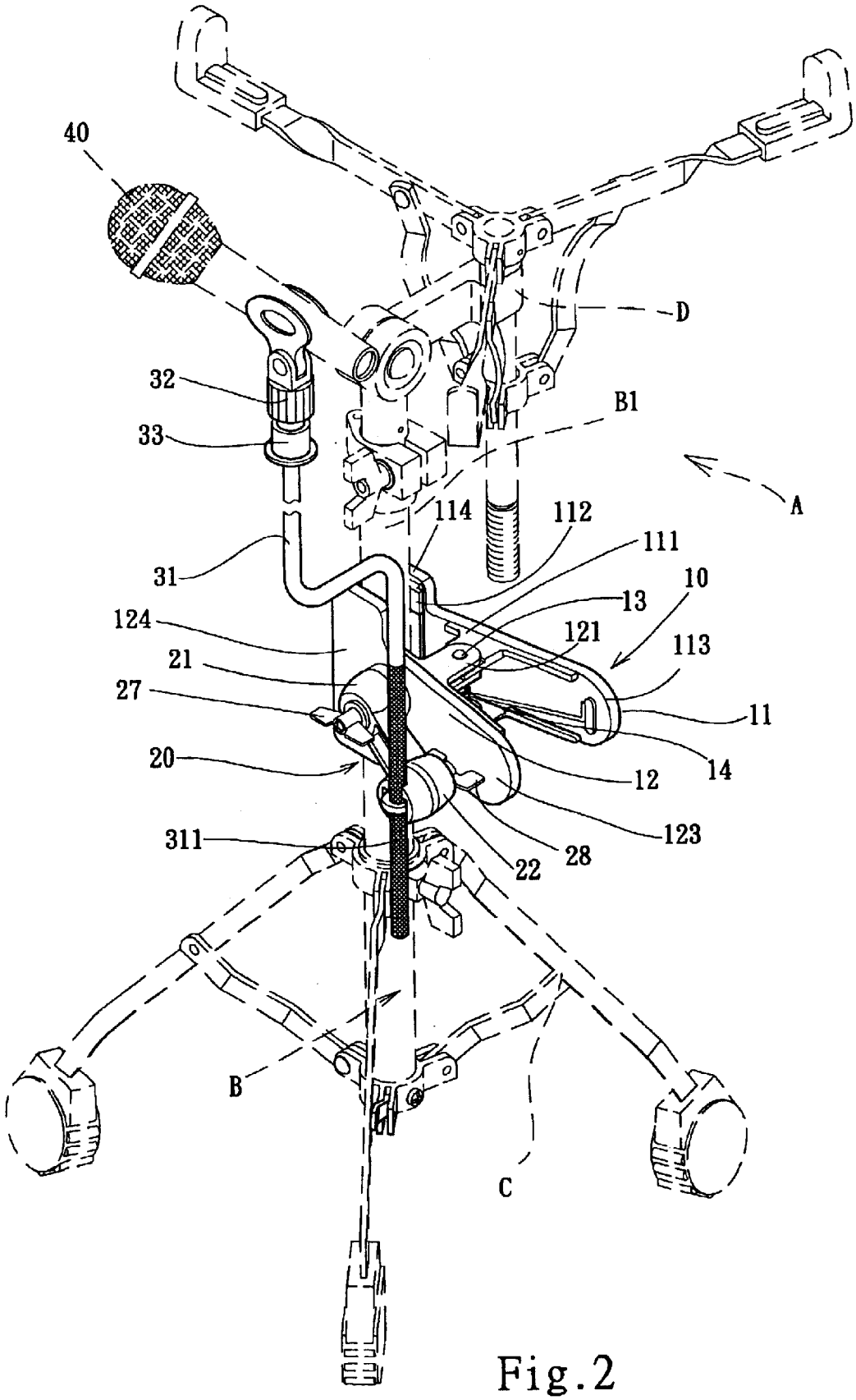
FIG. 2 is a perspective view of an embodiment of the invention.
Figure 3B:
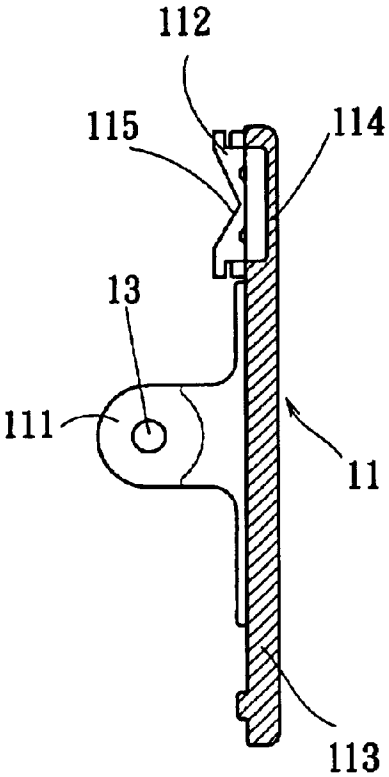
FIGS. 3A, 3B, 4A and 4B are front and sectional views of the anchor unit of the invention.
Figure 3A:
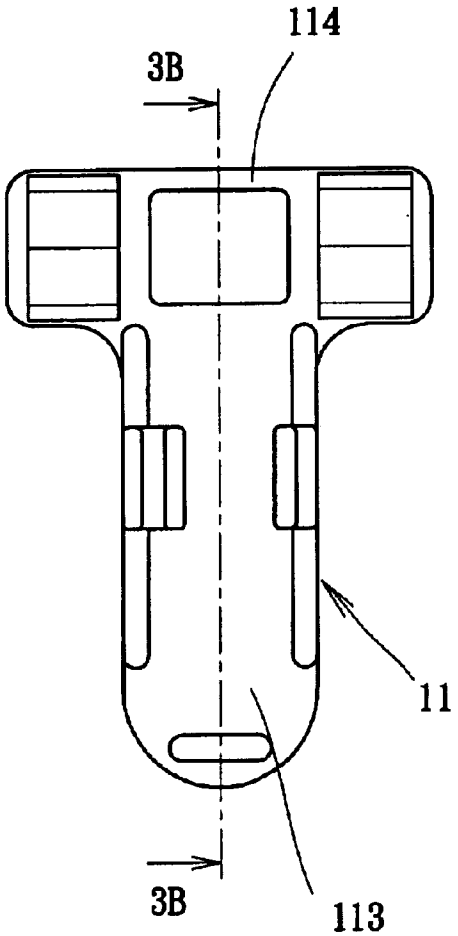
Figure 4B:
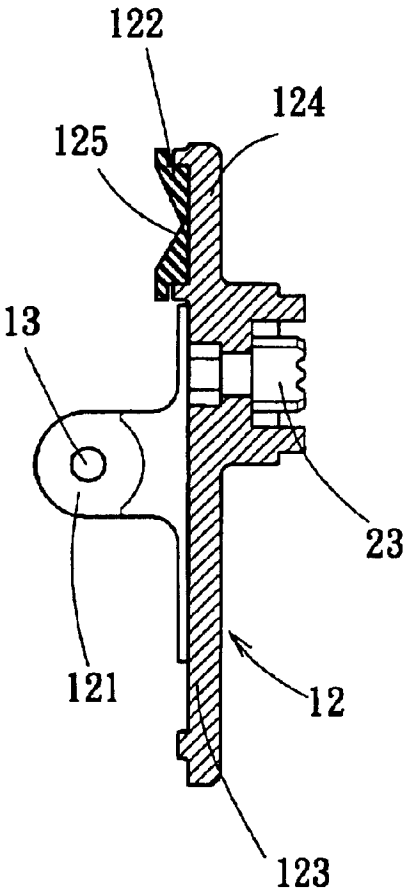
Figure 4A:
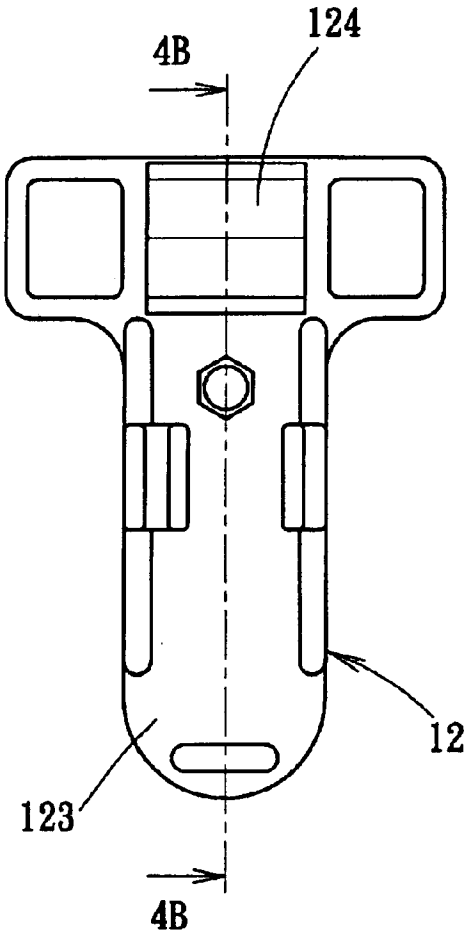

Refer FIGS. 1 and 2 for an embodiment of the invention. The musical instrument stand A includes a foot rack C standing on the floor, a post B which has one end fastening to the foot rack C and another end coupling with a mounting rack D for holding instruments (not shown in the drawings) (the instrument stand A is known in the art and forms no part of the invention, thus details are omitted). On the instrument stand A, besides the post B, all other space above the foot rack C is spaced space. Thus an anchor section B1 may be formed on the post B to couple with the anchor structure for holding a microphone 40 or additional instruments. The anchor structure includes an anchor unit 10 fixedly fastening to the anchor section B1, a holding unit 30 for holding the microphone 40 or additional instruments, and an adjusting unit 20 which has two ends coupling respectively with the anchor unit 10 and the holding unit 30 to form connecting relationship.

Referring to FIGS. 3A, 3B, 4A and 4B, the anchor unit 10 includes two symmetrical clips 11 and 12 facing each other with a lug 111 and 121 formed on an inner side thereof pivotally engaging with each other through a pin 13. The clips 11 and 12 is bridged by an elastic element 14 to define a force applying section 113 and 123 on one end and a pressing section 114 and 124 on another end with the pin 13 in the middle as the axis. In order to prevent the surface of the post B from being damaged and to reduce the vibration resulting from the instruments held on the mounting rack D, the pressing sections 114 and 124 have respectively a cushion pad 112 and 122 attached to the surface of contact. The cushion pads 112 and 122 have respectively a coupling notch 115 and 125 corresponding to the post B to facilitate up and down adjusting movements for the anchor structure. When a force is applied on the force applying section 113 and 123 to compress the elastic element 14, the elastic element stores the elastic force and the pressing sections 114 and 124 are moved away from each other so that the anchor structure may be moved upwards or downwards to adjust the elevation relative to the post B.

Figure 6:
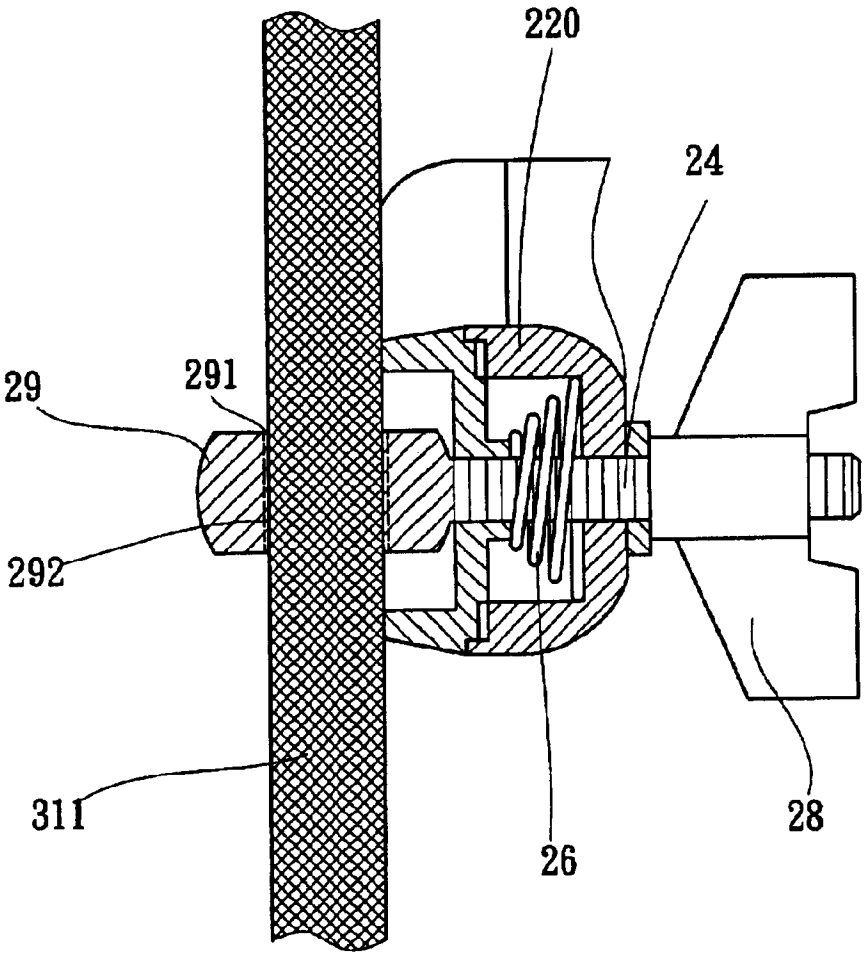
FIG. 6 is a sectional view of the connection unit of the invention.
Figure 5:
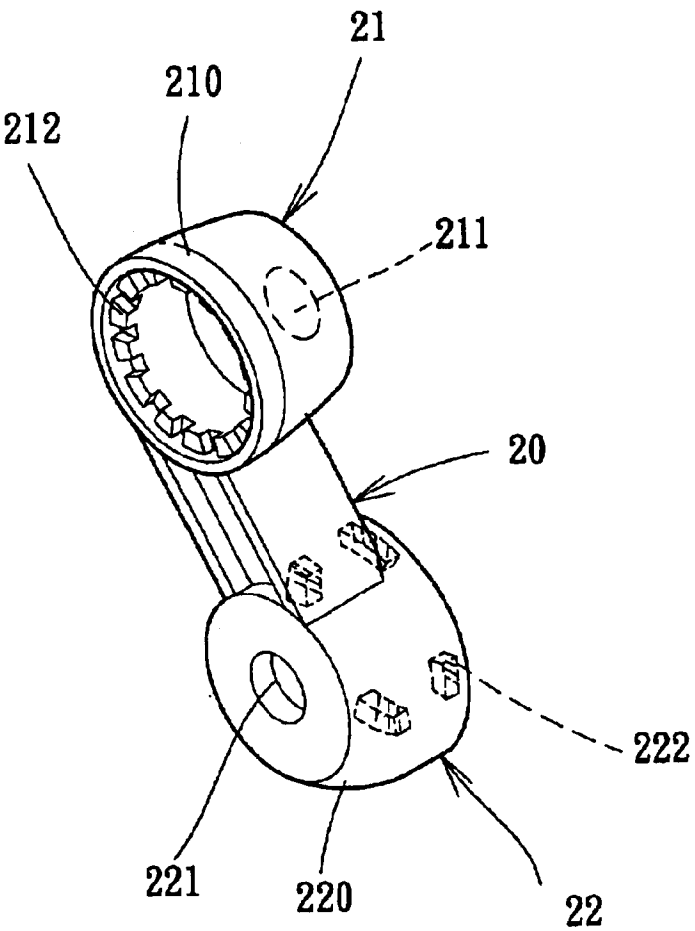
FIG. 5 is a perspective view of the connection unit of the invention.

Refer to FIGS. 1, 5 and 6 for the connection unit of the invention. The adjusting unit 20 has two ends formed respectively a first adjusting end 21 and a second adjusting end 22. The first adjusting end 21 and the second adjusting end 22 couple respectively with a bolt 23 and 24 that run through the anchor unit 10 and the holding unit 30, and are coupled with a spring 25 and 26. The bolts 23 and 24 are coupled respectively with an anchor hub 210 and 220 and an adjusting element 27 and 28. The anchor hubs 210 and 220 are formed respectively in two semi-spherical shapes and have an aperture 211 and 221 to enable the bolt 23 and 24 to run through. When users want to adjust the inclination angle of the anchor structure relative to the post B, turn the adjusting element 27 of the first adjusting end 21, and the bolt 23 may be moved horizontally to loosen the anchor hub 210, then adjustment of the inclination angle may be made. The second adjusting end 22 couples with the holding unit

30. The bolt 24 has one end exposed outside the anchor hub 220 to form a latch lug 29 and a latch trough 291. The latch trough 291 has embossed teeth traces 292 formed on the inner surface. The holding unit 30 includes an insert rod 31 to couple with the latch trough 291. The insert rod 31 has one end engaged with an anchor member 32 for holding the microphone 40 or additional instruments and another end formed embossed traces 311 corresponding to the embossed teeth traces 292 to facilitate coupling. When there is a desired to adjust the front or rear inclination angle of the insert rod 31, turn the adjusting element 28 on the second adjusting end 22, the bolt 24 may be moved horizontally to loosen the anchor hub 220 to adjust the inclination angle.

Figure 7:
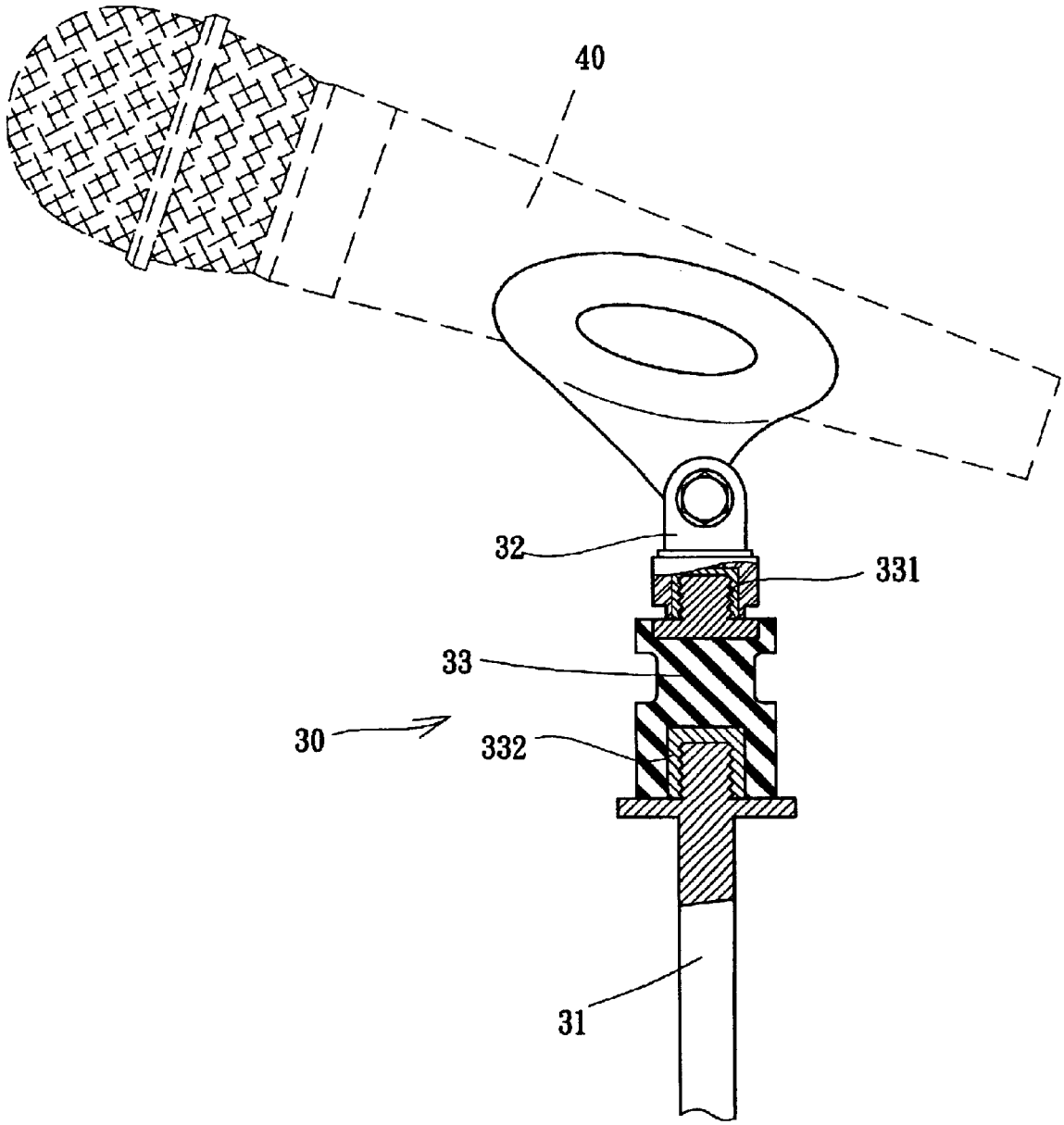
FIG. 7 is a sectional view of the holding unit of the invention.

Refer to FIG. 7 for the holding unit 30 of the invention. The holding unit 30 includes an anchor member 32 to couple with the microphone 40. In order to absorb vibration and prevent noises from occurring, a shock absorbing member 33 made from rubber is interposed between the anchor member 32 and the insert rod 31. The shock absorbing member 33 has an upper end and a lower end formed respectively a coupling member 331 and 332 to couple with the anchor member 32 and the insert rod 31 so that vibration generated by the instruments mounting on the mounting rack D may be absorbed by the cushion pads 112 and 122, then absorbed for the second time by the shock absorbing member 33 to eliminate the vibration that might occur from the instruments mounting on the mounting rack D.

In summary, the invention can effectively utilize the spared space on the instrument stand A to hold the microphone 40 or other additional accessories. The anchor unit 10 of the invention further is easy to unfasten to adjust the elevation. And the adjusting unit 20 may be used to adjust the inclination angle in various manners. Thus the invention can better meet user's requirements and achieve improved cost-effectiveness.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An anchor structure for accessories of a musical instrument stand that has a foot rack for standing on the floor, and a post with one end fastening to the foot rack and another end fastening to a mounting rack for holding instruments, and an anchor section on the post to couple with the anchor structure to hold a microphone or additional instruments, comprising:

an anchor unit fixedly fastening to the anchor section;

a holding unit for holding the microphone or the additional instruments; and an adjusting unit having two ends coupling respectively to the anchor unit and the holding unit to form connection relationship therewith, the anchor unit includes two symmetrical clips facing each other with a lug formed on an inner side thereof pivotally engaging with each other through a pin which serves as an axis, the clips being bridged by an elastic element which defines the clips about the pin in a force applying section on one end for opening and closing, and a pressing section on another end to clamp the post for anchoring.

2. The anchor structure of claim 1, wherein the pressing sections of the clips have respectively a cushion pad located on one side that clamps the post, the cushion pad having a coupling notch corresponding to the post.

3. The anchor structure of claim 1, wherein the adjusting unit has two ends formed respectively a first adjusting end and a second adjusting end, a pair of bolts with the first adjusting end and the second adjusting end being coupled respectively with one of the bolts of the pair that run through the anchor unit and the holding unit, and are coupled with a spring, the pair of bolts being coupled respectively with an anchor hub and an adjusting element.

4. The anchor structure of claim 3, wherein the anchor hub are formed respectively in two semi-spherical shape with corresponding engaging teeth formed on an inner peripheral surface and have an aperture to allow the bolt to run through.

5. The anchor structure of claim 3, wherein the bolt of the second adjusting end of the adjusting unit has one end exposed outside the anchor hub to form a latch lug and a latch trough, the latch trough has embossed teeth traces formed on the inner surface.

6. The anchor structure of claim 5, wherein the holding unit includes an insert rod to couple with the latch trough, the insert rod having one end engaged with an anchor member of the musical instrument stand for holding the microphone or the additional instruments.

7. The anchor structure of claim 6, wherein the insert rod has another end formed embossed traces corresponding to the embossed teeth traces of the latch trough.

8. The anchor structure of claim 6 further having a shock absorbing member interposed between the anchor member and the insert rod.

9. The anchor structure of claim 8, wherein the shock absorbing member is made from rubber.

10. The anchor structure of claim 8, wherein the shock absorbing member has an upper end and a lower end forming respectively a coupling member to couple with the insert rod and the anchor member.

* * * * *